US006946995B2

(12) United States Patent
Choi et al.

(10) Patent No.: US 6,946,995 B2
(45) Date of Patent: Sep. 20, 2005

(54) MICROSTRIP PATCH ANTENNA AND ARRAY ANTENNA USING SUPERSTRATE

(75) Inventors: Won Kyu Choi, Gyeonggi-Do (KR); Sig Pyo Cheol, Daejon (KR); Jong Moon Lee, Chungcheongbuk-Do (KR); Young Keun Yoon, Chungcheongbuk-Do (KR); Yong Heui Cho, Daejon (KR); Jong-Suk Chae, Daejon (KR); Jae Ick Choi, Daejon (KR)

(73) Assignee: Electronics and Telecommunications Research Institute (KR)

( * ) Notice: Subject to any disclaimer, the term of this patent is extended or adjusted under 35 U.S.C. 154(b) by 11 days.

(21) Appl. No.: 10/637,843

(22) Filed: Aug. 8, 2003

(65) Prior Publication Data

US 2004/0104852 A1 Jun. 3, 2004

(30) Foreign Application Priority Data

Nov. 29, 2002 (KR) ..... 10-2002-0075401

(51) Int. Cl.[7] ..... H01Q 1/36
(52) U.S. Cl. ..... 343/700 MS; 343/895
(58) Field of Search ..... 343/700 MS, 702, 343/895, 909–910

(56) References Cited

U.S. PATENT DOCUMENTS 6,075,485 A * 6/2000 Lilly et al. ..... 343/700 MS
6,359,588 B1 * 3/2002 Kuntzsch ..... 343/700 MS
6,650,294 B2 * 11/2003 Ying et al. ..... 343/700 MS
2004/0104847 A1 * 6/2004 Killen et al. ..... 343/700 MS

FOREIGN PATENT DOCUMENTS

JP 1999-84409 12/1999

OTHER PUBLICATIONS

"A Novel Low Profile Slot–multi–layer Patch Antenna", M. Fan, et al., 2001 IEEE, pp. 196–201.

* cited by examiner

*Primary Examiner*—Don Wong
*Assistant Examiner*—Jimmy Vu
(74) *Attorney, Agent, or Firm*—Blakely Sokoloff Taylor & Zafman

(57) ABSTRACT

The present invention provides a microstrip patch antenna and array antenna using dielectric superstrate in order to enhance the antenna gain by stacking radiating patches and dielectric layers. The microstrip patch antenna using a dielectric superstrate for having high gain and wide bandwidth, includes: a lower patch antenna layer having a dielectric layer and a ground plane for radiating energy by exciting current by a feedline; a upper patch antenna layer having dielectric film electromagnetically coupled by the lower radiating patch; a foam layer for distancing the upper patch antenna layer from the lower patch antenna layer; and a dielectric superstrate located by being predeteremined distant from the upper patch antenna layer.

6 Claims, 10 Drawing Sheets

MICROSTRIP PATCH ANTENNA AND ARRAY ANTENNA USING SUPERSTRATE

FIELD OF THE INVENTION

The present invention relates to a microstrip patch antenna and array antenna using a dielectric superstrate, and particularly to a microstrip patch antenna using a dielectric superstrate and an array antenna using the same, for a wireless communication base station, a wireless local area network, satellite communications and satellite broadcasting.

DESCRIPTION OF THE PRIOR ART

The concept of microstrip radiators was first proposed by Deschamps as early as 1953. There are many advantages and disadvantages of microstrip antennas compared with other microwave antennas. The advantages include lightweight, low volume, low profile planar configurations and low fabrication cost. However, the microstrip antennas have disadvantages such as narrow bandwidth and low antenna gain.

FIGS. 1A and 1B are a cross-sectional view and a perspective view of a typical microstrip patch antenna.

As shown in FIGS. 1A and 1B, a typical microstrip patch antenna has a ground plane 101, a dielectric layer 102, a radiating patch 103, and a feedline 104.

The dielectric layer 102 is placed on the ground plane 101 that is a conductor and the feedline 104 and the radiating patch 103 are formed on the dielectric layer 102.

However, a structure of the typical microstrip patch antenna does not provide broadband impedance characteristics.

In order to obtain a high gain antenna required for a base station of a wireless communication system, a wireless local area network and a satellite, the number of radiating patches are increased and the size of the antenna is enlarged.

Despite of increase in the number of radiating patches, it is difficult to obtain a high gain microstrip antenna because of large feeding loss.

To solve the problem of large feeding loss, a microstrip patch antenna using a superstrate is disclosed by X. H. Shen in "Effect of superstrate on radiated field of probe fed microstrip patch antenna", IEEE proc. Micro. Antenna Propag., Vol. 148, No. 3, pp. 131–146, 2001. 06.

FIGS. 2A and 2B are a cross-sectional view and a perspective view of a microstrip patch antenna using superstrate disclosed by X. H. Shen.

Referring to FIGS. 2A and 2B, a microstrip patch is fed by a coaxial cable. As a dielectric layer having high permittivity is formed on the microstrip patch, radiating field is focused on boresight direction.

However, the microstrip antenna of FIGS. 2A and 2B has a problem such as a narrow impedance bandwidth because a radiating patch is on a single layer substrate and it is not adequate to make an array antenna by using the microstrip antenna of FIGS. 2A because the radiating patch is fed to the coaxial cable.

For overcoming above mentioned problem, a wideband microstrip patch antenna is disclosed at Korean Patent application No. 2001-47913 entitled "Wideband microstrip patch array antenna with high efficiency."

FIGS. 3A and 3B are a cross-sectional view and a perspective view of a conventional microstrip stacked patch antenna printed on dielectric film which is disclosed at Korean Patent application No. 2001-47913.

Referring to FIGS. 3A and 3B, a dielectric layer 102 is placed on a ground plane 101, and a feedline 104 and a first radiating patch 103 are formed on the dielectric layer 102.

A foam layer 301 is placed on the feedline 104 and the lower radiating patch 103, a dielectric film 302 is formed on the foam layer 301, and a upper radiating patch 303 is placed on the dielectric film 302.

Although the stacked layers of the microstrip patch antenna is proper to enhance impedance bandwidth characteristics, the antenna gain is not high enough to meet the requirement of the current needs such as a wireless communication base station, a wireless local area network, satellite communications and satellite broadcasting.

SUMMARY OF THE INVENTION

Therefore, it is an object of the present invention to provide a microstrip patch antenna using a dielectric superstrate in order to enhance the antenna gain by stacking radiating patches and dielectric layers.

In accordance with an aspect of the present invention, there is provided a microstrip patch antenna using a dielectric superstrate for having high gain and broadband, including: a lower patch antenna layer having a dielectric layer and a ground plane, for radiating energy by exciting current by a feedline electrically connected to a lower radiating patch on a side of the dielectric layer; an upper patches on a dielectric film electromagnetically coupled by the lower radiating patch; a foam layer for distancing the upper patch antenna layer from the lower patch antenna layer by arranging the foam layer between the lower patch antenna layer and the upper patch antenna layer; and a dielectric superstrate located with predeteremined distance from the upper patch antenna layer.

In accordance with an aspect of the present invention, there is provided a microstrip array antenna, including microstrip patch antennas, each of which uses a dielectric superstrate, wherein the microstrip patch antenna includes: a lower patch antenna layer having a dielectric layer and a ground plane, for radiating energy by exciting current by a feedline electrically connected to a lower radiating patch on a side of the dielectric layer; an upper patches on a dielectric film electromagnetically coupled by the lower radiating patch; a foam layer for distancing the upper patch antenna layer from the lower patch antenna layer by arranging the foam layer between the lower patch antenna layer and the upper patch antenna layer; and a dielectric superstrate located with predeteremined distance from the upper patch antenna layer, wherein the array antenna is designed using the corporate feeding method and the element spacing of the microstrip patch antennas is more than 1λ0 at 12 GHz to minimize the coupling, wherein although the element spacing in the array is wider than the wavelength in free space, the grating lobes can be reduced by the superstrate.

BRIEF DESCRIPTION OF THE DRAWINGS

The above and other objects and features of the instant invention will become apparent from the following description of one embodiment taken in conjunction with the accompanying drawings, in which.

DETAILED DESCRIPTION OF THE PREFERRED EMBODIMENTS

Hereinafter, one embodiment of the present invention and measurement results will be described in detail with reference to the accompanying drawings.

Figure 4A:
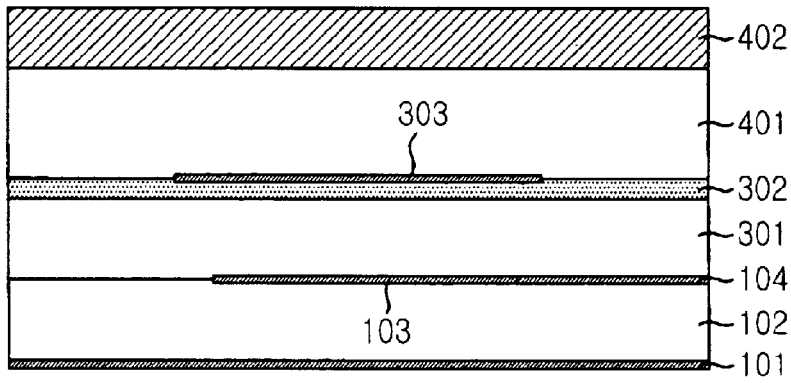
FIGS. 4A and 4B are a cross-sectional view and a perspective view of a microstrip patch antenna in accordance with the present invention.
Figure 4B:
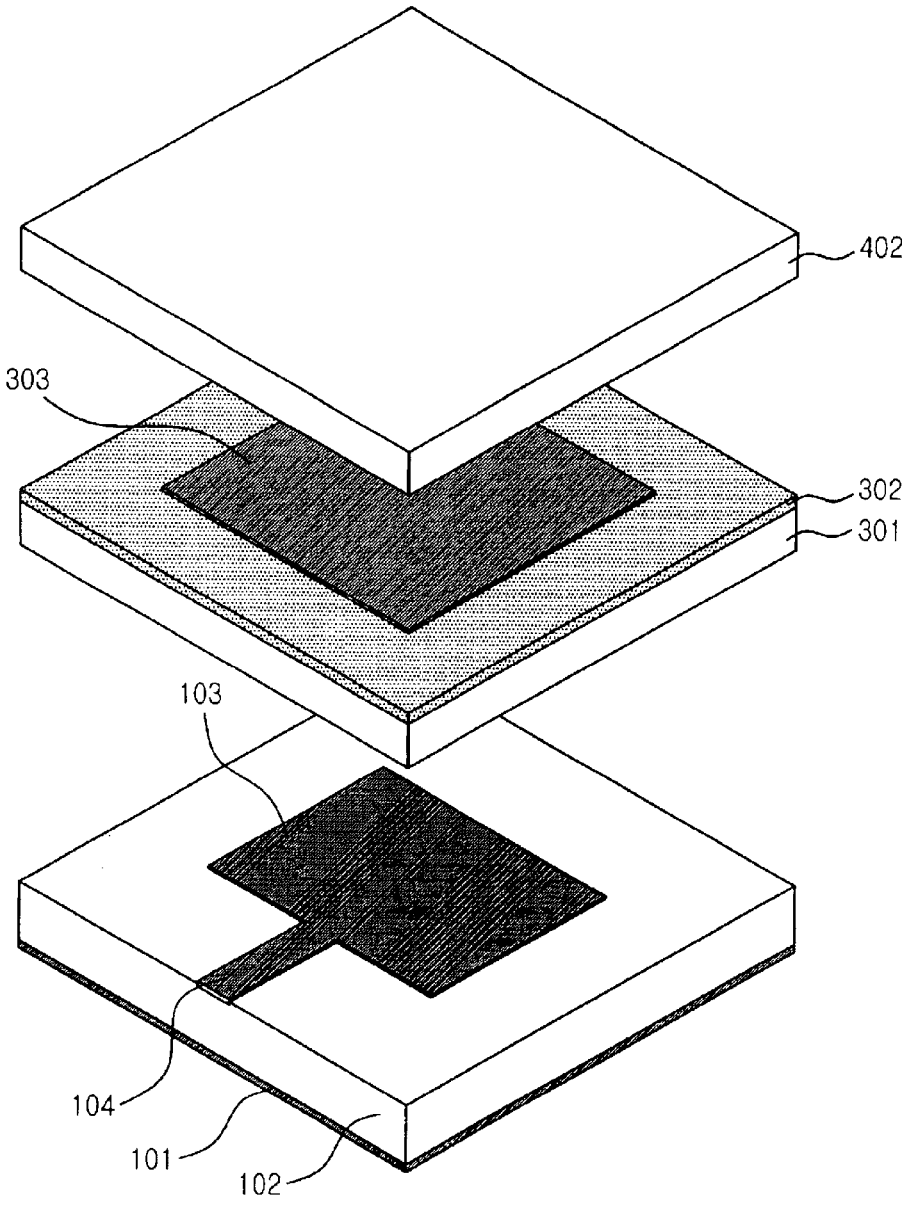

FIGS. 4A and 4B are a cross-sectional view and a perspective view of a microstrip patch antenna in accordance with the present invention.

Referring to FIGS. 4A and 4B, a dielectric layer 102 is formed on a ground plane 101, and a feedline 104 and a lower radiating patch 103 are formed on the dielectric layer 102 in the microstrip patch antenna in accordance with the present invention. The feedline 104 is electrically connected to the lower radiating patch 103.

A foam layer 301 is formed on the feedline 104 and the lower radiating patch 103, a dielectric film 302 is formed on the foam layer 301, and an upper radiating patch 303 is placed on the dielectric film 302.

An airgap 401 having a predetermined thickness is placed on the upper radiating patch 303 and a high permittivity dielectric superstrate 402 having a predetermined thickness is formed over the airgap 401.

The upper radiating patch is stacked upon the lower radiating patch (103) by electromagnetically coupling each other efficiently.

Coupling efficiency is obtained by electromagnetically coupling the upper radiating patch 303 to the lower radiating patch 103 that is connected to the feedline 104.

The bandwidth and the gain of the antenna are determined by the thickness of the dielectric superstrate 402 and a dielectric constant. Also, resonant characteristics can be largely varied by the thickness of the airgap 410.

If the thick dielectric superstrate 402 and high dielectric constant are used, the gain is increased but the bandwidth becomes narrow. If the thin dielectric superstrate 402 and low dielectric constant are used, the gain tends to be decreased but the impedance bandwidth tends to be broadened.

Therefore, it is adequate to use radiating element having high radiating efficiency and wide bandwidth characteristics along with the superstrate 402 of the present invention for obtaining high gain and wide bandwidth characteristics.

Figure 5A:
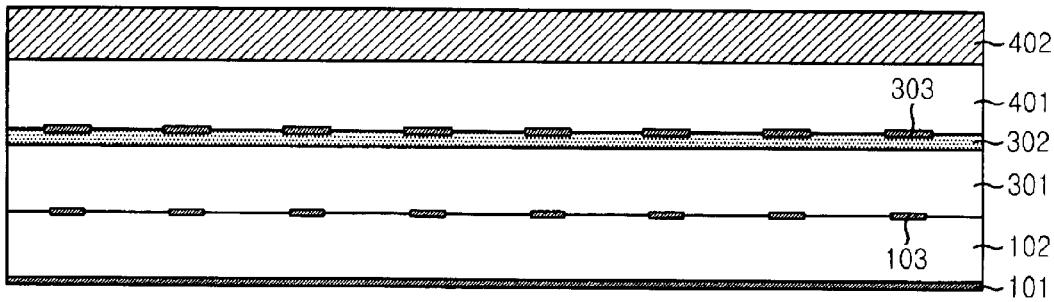
FIG. 5A is a cross-sectional view of a microstrip array antenna using a dielectric superstrate in accordance with the present invention and is an array structure of the microstrip patch antenna of FIG. 4A.
Figure 5B:
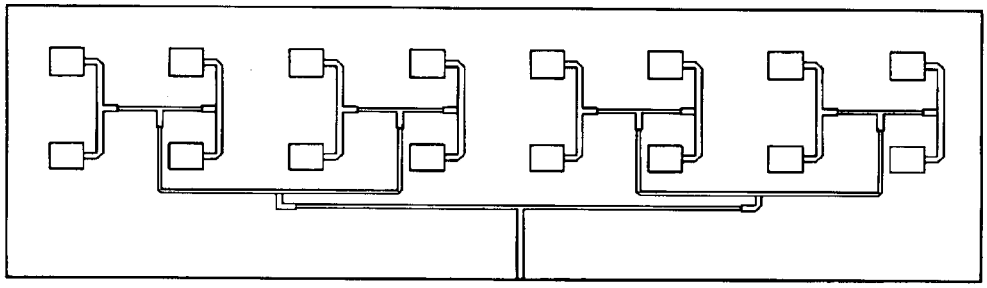
FIGS. 5B and 5C are top views of a dielectric layer and a dielectric film in accordance with the present invention.
Figure 5C:
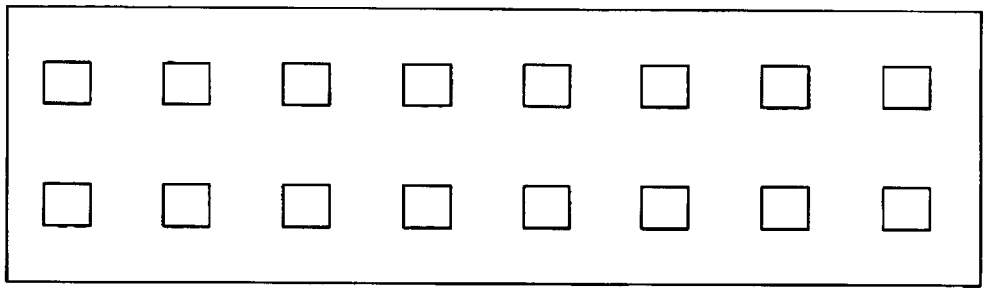

FIG. 5A is cross-sectional view of a microstrip array antenna using dielectric superstrate in accordance with the present invention. The microstrip array antenna of FIG. 5A is array structure of single radiating element. FIGS. 5B and 5C are top views of a dielectric layer and a dielectric film in accordance with the present invention.

The microstrip patch antenna is designed so that radiation field radiated from each radiating patch can obtain a high directivity in the dielectric layer 402.

The distance between each radiating patches is more than 1λ0 in this embodiment.

As shown in FIG. 4A, the thickness of the dielectric layer 402 and the dielectric constant can largely affect the bandwidth and the gain characteristics.

Figure 1A:
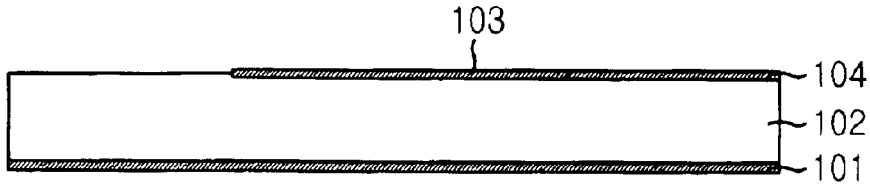
FIGS. 1A and 1B are a cross-sectional view and a perspective view of a typical microstrip patch antenna.
Figure 1B:
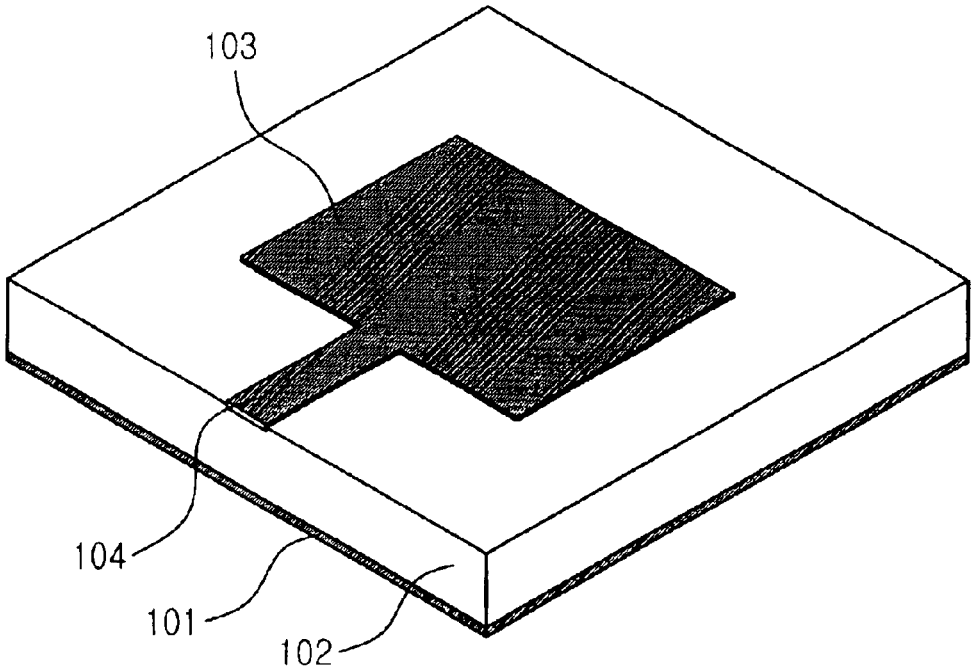
Figure 2A:
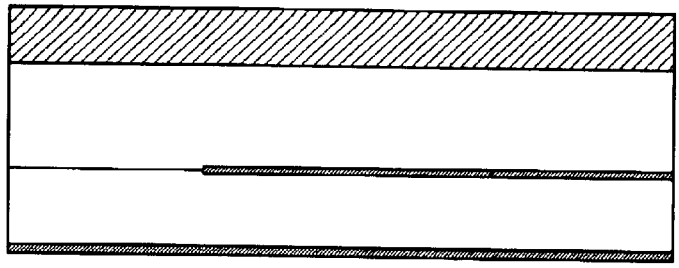
FIGS. 2A and 2B are a cross-sectional view and a perspective view of a conventional microstrip patch antenna using superstrate.
Figure 2B:
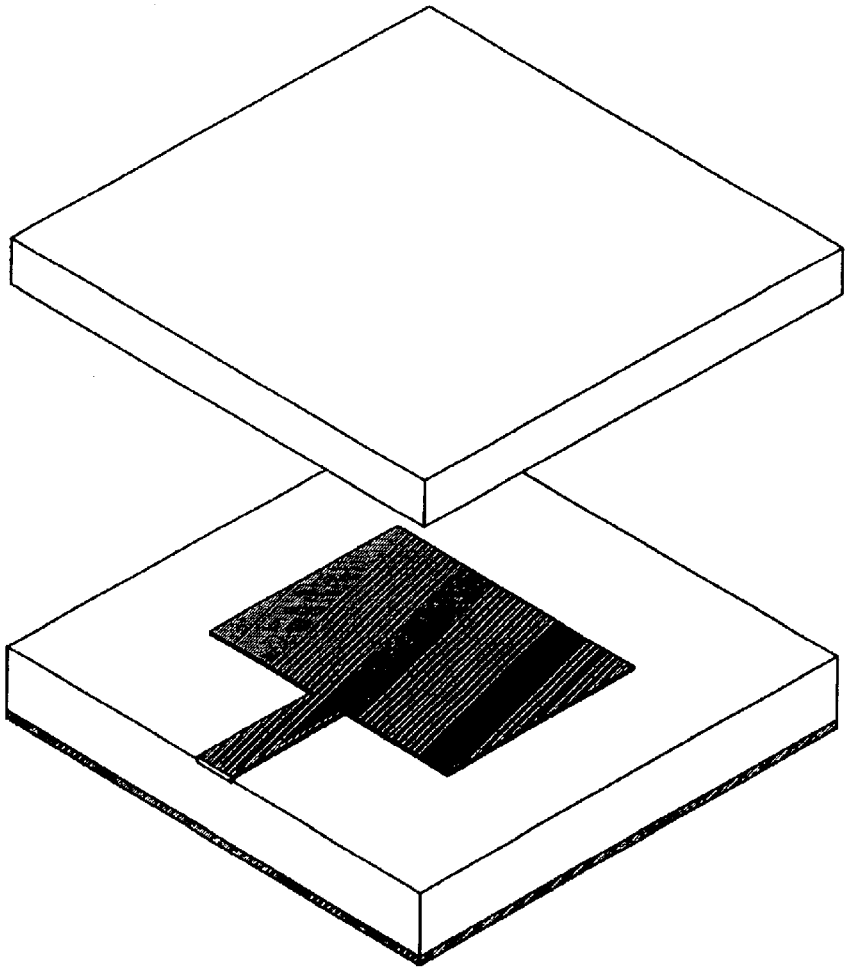
Figure 3A:
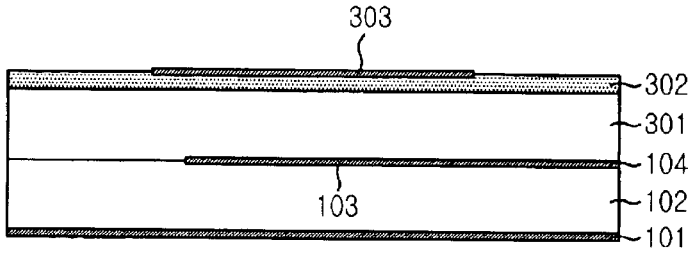
FIGS. 3A and 3B are a cross-sectional view and a perspective view of a conventional microstrip stacked patch antenna printed on a dielectric film.
Figure 3B:
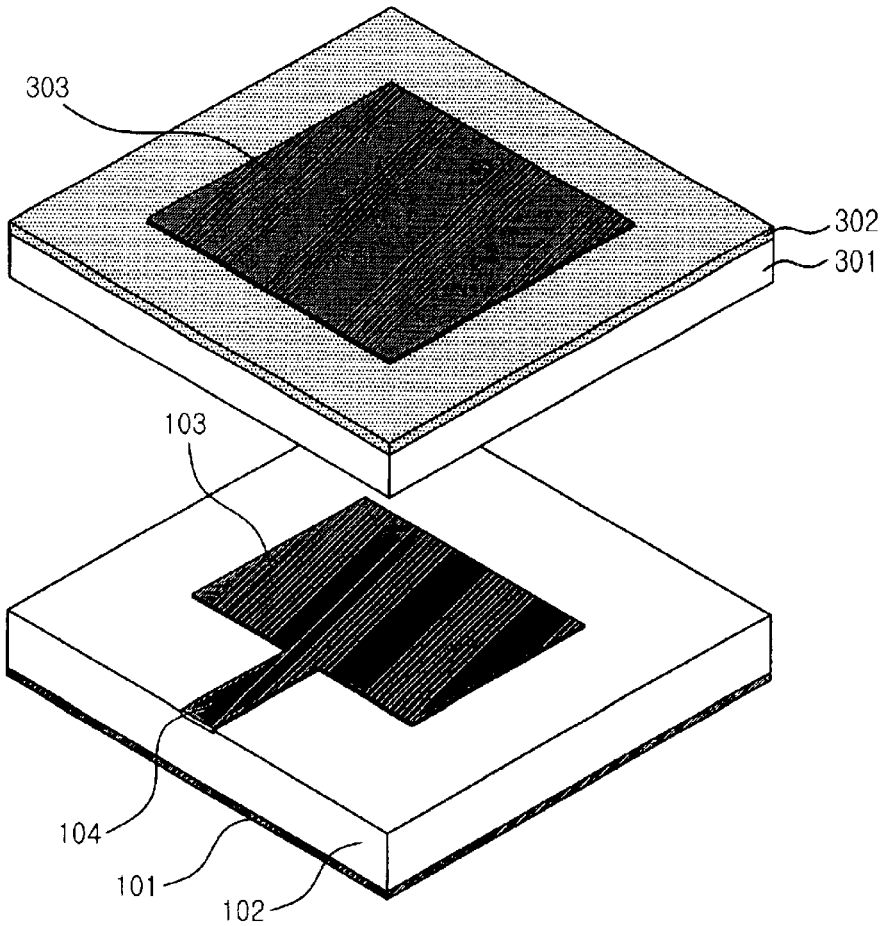
Figure 6:
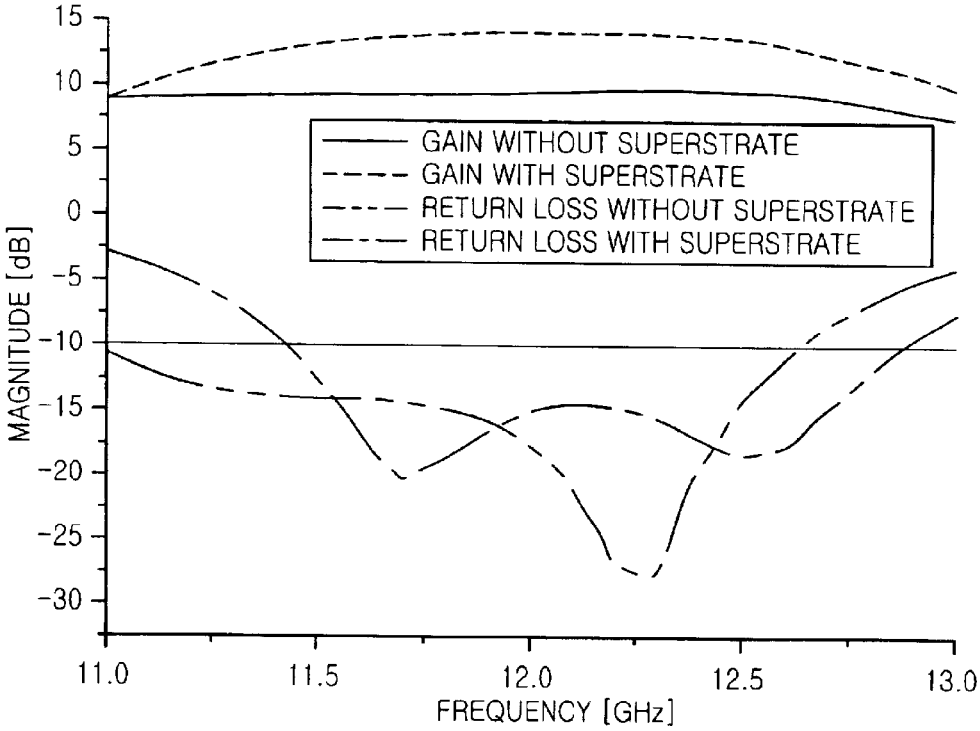
FIG. 6 is a graph showing gain characteristics and return loss bandwidth characteristics of a microstrip patch antenna having a superstrate shown in FIG. 4 and a microstrip patch antenna without a superstrate shown in FIG. 3.

FIG. 6 is a graph showing gain characteristics and return loss bandwidth characteristics of a microstrip patch antenna with a superstrate shown in FIG. 4 and a microstrip patch antenna without a superstrate shown in FIG. 3.

Figure 7:
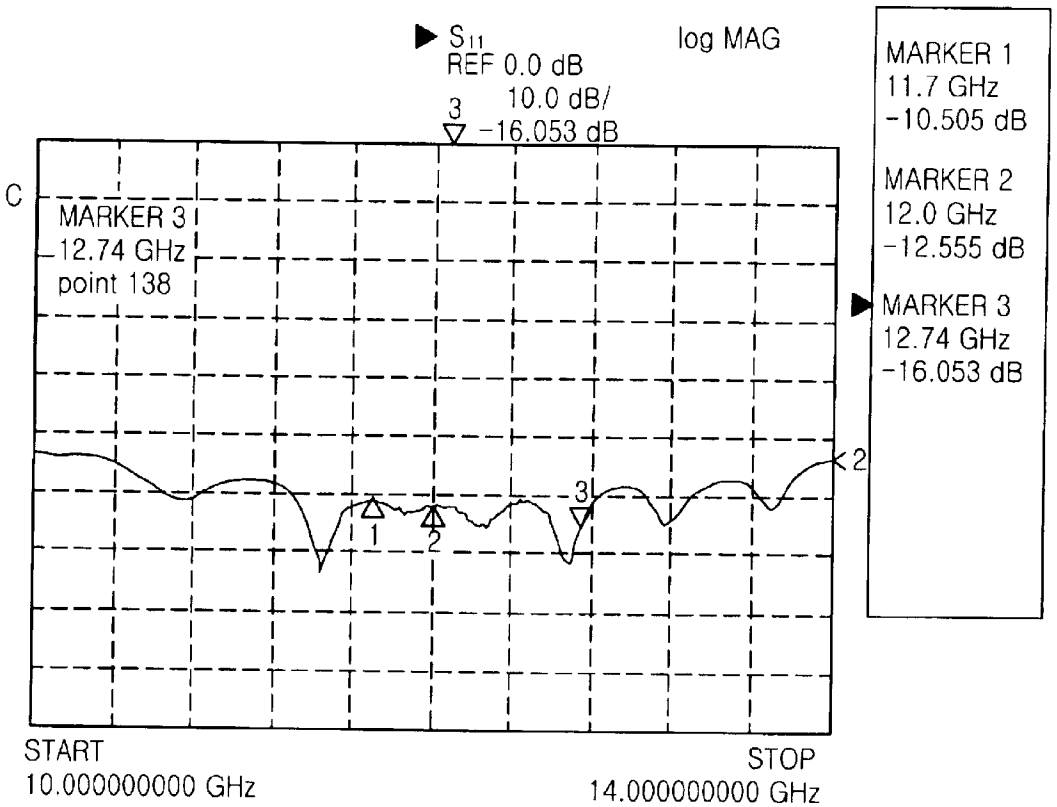
FIGS. 7, 8A and 8B are graphs showing measured return loss and radiation pattern of a microstrip patch antenna using dielectric superstrate in accordance with the present invention.
Figure 8A:
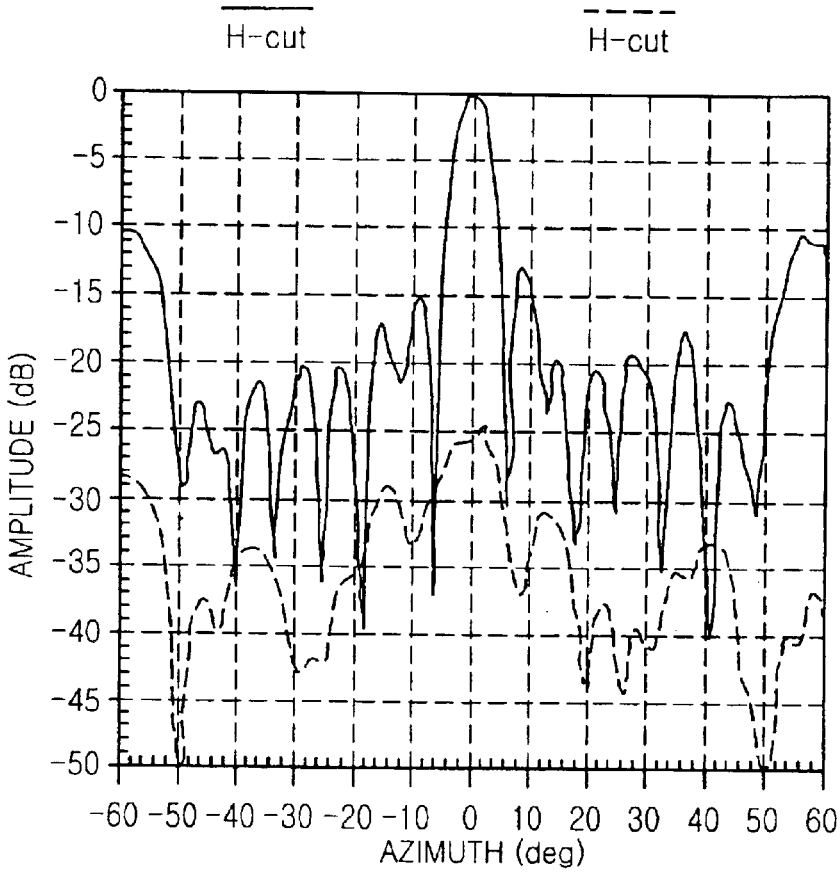
Figure 8B:
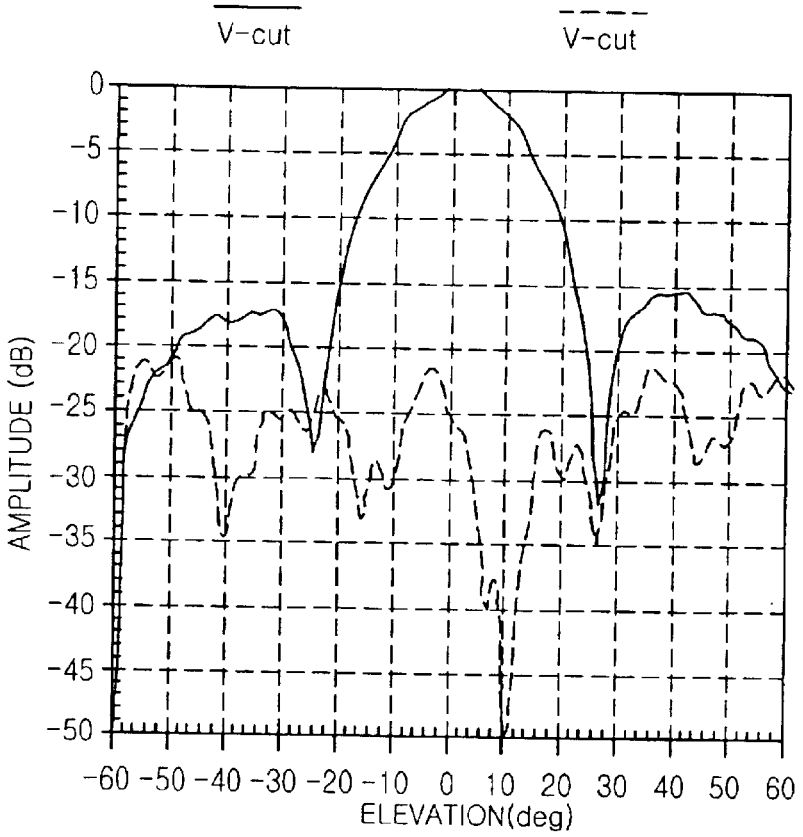

FIGS. 7, 8A and 8B are graphs showing measured return loss and radiation pattern of a microstrip patch antenna using dielectric superstrate in accordance with the present invention.

Referring to FIG. 6, the microstrip patch antenna using dielectric superstrate in accordance with the present invention outperforms the conventional microstrip patch antenna.

The gain of the microstrip patch antenna using dielectric superstrate in accordance with the present invention is enhanced about 4 dBi than that of the conventional microstrip patch antenna.

In case of 2×8 microstrip array antenna in accordance with the present invention, 10 dB return loss bandwidth is 12.6%, i.e., center frequency is 12 GHz, side lobe level in E-plane is less than 10 dB, side lobe level in H-plane is less than 15 dB, and cross polarization level is less than 25 at boresight.

Also, 2×8 microstrip array antenna in accordance with the present invention has the gain of about 23 dBi which is about 3 dBi higher than the prior microstrip array antenna.

As mentioned above, the present invention can improve performances of antenna gain, radiation efficiency, and bandwidth characteristics by using radiation element having wide impedance bandwidth and dielectric layer having high permittivity.

Also, a size of the microstrip antenna used in satellite communication systems and satellite broadcasting systems is reduced by using the present invention.

Therefore, the present invention can also be used in the field of wireless local area network because of the high gain characteristics of the present invention.

While the present invention has been shown and described with respect to the particular embodiments, it will be apparent to those skilled in the art that many changes and modifications may be made without departing from the spirit and scope of the invention as defined in the appended claims.

What is claimed is:

1. A microstrip patch antenna, comprising:

a lower patch antenna layer having a dielectric layer and a ground plane, for radiating energy by exciting current by a feeding means electrically connected to a lower radiating patch on a side of the dielectric layer;

a foam layer for distancing the upper patch antenna layer from the lower patch antenna layer by arranging the foam layer between the lower patch antenna layer and the upper patch antenna layer;

a dielectric film on the foam layer;

an upper patch antenna layer having a dielectric film, for radiating energy by exciting current by the lower radiating patch electromagnetically connected to an upper radiating patch on a side of the dielectric film; and a dielectric superstrate located a predeteremined distance above the upper patch antenna layer.

2. The apparatus as recited in claim 1, wherein the upper radiating patch is stacked upon the lower radiating patch.

3. The apparatus as recited in claim 1, wherein the thickness and the dielectric constant of the dielectric superstrate determine the bandwidth and gain of the microstrip patch antenna.

4. The apparatus as recited in claim 3, wherein as the thickness of the dielectric superstrate becomes thicker and the dielectric constant of the dielectric superstrate is increased, the gain of the antenna tends to be higher and the bandwidth of the antenna tends to be narrower.

5. The apparatus as recited in claim 1, wherein the predetermined distance between the upper patch antenna layer and the dielectric superstrate largely affects the resonant characteristics of the microstrip patch antenna.

6. A microstrip array antenna having a plurality of microstrip patch antennas, each of the microstrip patch antenna comprising:

a lower patch antenna layer having a dielectric layer and a ground plane, for radiating energy by exciting current by a feeding means electrically connected to a lower radiating patch on a side of the dielectric layer;

a foam layer for distancing the upper patch antenna layer from the lower patch antenna layer by arranging the foam layer between the lower patch antenna layer and the upper patch antenna layer;

a dielectric film on the foam layer;

an upper patch antenna layer having a dielectric film, for radiating energy by exciting current by the lower radiating patch electromagnetically connected to an upper radiating patch on a side of the dielectric film; and a dielectric superstrate located a predeteremined distance above the upper patch antenna layer, wherein the microstrip array antenna is designed using a corporate feeding method and an element spacing of the microstrip patch antennas is more than 1λ0 at 12 GHz to minimize the coupling between the microstrip patch antennas, wherein although the element spacing in the array is wider than the wavelength at 12 GHz in free space, the grating lobes can be reduced by the dielectric superstrate.

* * * * *